United States Patent [19]

Kamper

[11] Patent Number: 4,784,371

[45] Date of Patent: Nov. 15, 1988

[54] HYDRAULIC JACK HAVING A SMALL DIAMETER BLEED PART IN THE CYLINDER WALL

[75] Inventor: William L. Kamper, Waukesha, Wis.

[73] Assignee: Hein-Werner Corporation, Waukesha, Wis.

[21] Appl. No.: 74,089

[22] Filed: Jul. 16, 1987

[51] Int. Cl.[4] ..... B66F 3/24

[52] U.S. Cl. ..... 254/93 H

[58] Field of Search ..... 91/401, 402; 417/435; 254/93 H, 93 R

[56] References Cited

U.S. PATENT DOCUMENTS

| | | | |
|---|---|---|---|
| 1,550,254 | 8/1925 | Hewey | 91/402 |
| 1,624,151 | 4/1927 | Shevein | 254/93 H |
| 2,456,105 | 12/1948 | Berg . | |
| 3,685,797 | 8/1972 | Orr . | |
| 3,806,091 | 4/1974 | Wride | 254/93 R |
| 3,818,805 | 6/1974 | Johansson . | |
| 3,890,684 | 6/1975 | Tallman | 254/93 H |
| 3,925,985 | 12/1975 | Peterson . | |
| 4,077,608 | 3/1978 | Nehrig . | |

FOREIGN PATENT DOCUMENTS 1954936 10/1969 Fed. Rep. of Germany .

*Primary Examiner*—Robert C. Watson

*Attorney, Agent, or Firm*—Michael, Best & Friedrich

[57] ABSTRACT

A hydraulic jack including a bleed port for permitting the flow of fluid from the ram cylinder when the head portion of the ram moves to a position adjacent one end of the cylinder so as to prevent the ram head portion from being forced and the sealing means against the end of the cylinder. The bleed port means comprises a bore formed by a laser beam and extending through the cylinder wall, the bore having a diameter of less than approximately 0.015 inches along substantially its entire length.

3 Claims, 1 Drawing Sheet

HYDRAULIC JACK HAVING A SMALL DIAMETER BLEED PART IN THE CYLINDER WALL

FIELD OF THE INVENTION

The present invention relates to hydraulic cylinders of the type employed in hydraulic lift jacks and more particularly to bleed ports of hydraulic cylinders and methods for making bleed ports.

BACKGROUND PRIOR ART

Hydraulic cylinders and hydraulic lift jacks normally include a bleed port in the cylinder wall adjacent the rod end of the cylinder such that as the piston head approaches the rod end of the cylinder, the bleed port will be uncovered and hydraulic fluid will be vented to the reservoir. The bleed port functions to limit the stroke of the piston in the cylinder and prevents generation of excessive hydraulic pressure in the cylinder. Examples of prior art cylinders having bleed ports are illustrated in the U.S. Pat. No. 3,685,797, issued Aug. 22, 1972, Orr and in the U.S. Pat. No. 4,077,608, issued Mar. 7, 1978, Nehrig. Attention is also directed to the U.S. Pat. No. 2,456,105, issued Dec. 14, 1948, Berg, the U.S. Pat. No. 3,818,805, issued June 25, 1974, Johansson; the U.S. Pat. No. 3,925,985, issued Dec. 16, 1975, Peterson and Offenlegungsschrift No. 1 954 936.

As set forth in the Orr patent, in the manufacture of hydraulic jacks, the seal at the head of the piston is economically manufactured from a plastic material. In the prior art arrangements, the groove or bleed port may cause scoring or wear of the plastic seal and thereby reduce the wear life of the seal and the cycle life of the cylinder.

In order to reduce the wear of the piston head seal, it is preferred that the diameter of the bleed port be as small as possible. In prior constructions such small diameter bleed ports have been formed by drilling a first hole through a substantial portion of the thickness of the cylinder wall from the outside of the cylinder wall radially inwardly. A much smaller diameter hole or bore is then drilled through the remaining material of the cylinder wall. It has been found that this small bore can have a diameter of 0.010 to 0.012 inches. Bores of this size cause less wear of the piston head seal and facilitate longer wear life of the seal.

The thickness of the cylinder wall may commonly be in the range of 0.090 to 0.250 inches. It is not economically feasible to drill a hole of 0.010 to 0.012 inches diameter through the entire thickness of this cylinder wall. Drills having such small diameters are very fragile and normally have a shank length insufficient to drill through a cylinder wall of such a thickness. Machining operations using such a small drill are also time consuming, and require highly skilled machinists.

Another manufacturing problem encountered with prior art methods for forming very small diameter bleed ports in the inner surface of the cylinder wall is that the internal surface of the cylinder surrounding a drilled bleed port must be honed or polished. The drilling operation produces a burr on the interior surface of the cylinder, and this burr may result in substantial scoring or wear of the seal surrounding the piston head. The honing operation must be done manually and may also force metal filings or material back into the bleed port thereby plugging or restricting the bleed port. Because the bleed port diameters are so small, they cannot be effectively visually inspected. In some cases a plugged bleed port may not be discovered until there has been a failure of the hydraulic cylinder.

SUMMARY OF THE INVENTION

The present invention comprises an improved method for forming a small diameter bleed port in a hydraulic cylinder wall. The method of the invention requires fewer operations than the prior art two step drilling processes, eliminates the otherwise required honing operations and can be accomplished with automatic equipment and with a minimum of skilled operators. In the method of the invention, the small diameter bleed port bore is formed in the cylinder wall by directing a laser beam at the cylinder wall to thereby form a bore extending radially through the entire thickness of the cylinder wall, that bore having a very small cross sectional area.

More particularly, the invention includes a hydraulic jack including a cylinder, a reciprocable ram in the cylinder having a rod portion extending through one end of the cylinder and sealing means carried on the ram head to provide a substantially fluid tight seal between the ram head and the cylinder wall interior surface. Bleed port means are provided for permitting the flow of fluid from the cylinder when the head portion moves upwardly to a position adjacent the end of the cylinder so as to prevent the ram head portion and the sealing means from being forced against the end of the cylinder. The bleed port means comprises a bore extending through the cylinder wall and being formed by a laser beam.

In one embodiment of the invention the bleed port will have a diameter of less than approximately 0.015 inches along its entire length.

The invention also includes a method for forming a small diameter hydraulic fluid bleed port extending through the cylinder and having a diameter of less than approximately 0.015 inches along substantially its entire length. The method includes the steps of positioning the cylinder, directing a laser beam at a surface portion of the cylinder such that the laser beam extends generally radially with respect to the longitudinal axis of the cylinder, and causing the laser beam to burn a hole through the material forming the cylinder wall to form the bleed port.

In a preferred form of the invention the step of causing the laser beam to burn a hole includes forming a generally cylindrical bore having a diameter of approximately 0.010 to 0.012 inches.

Various other features and advantages of the invention will be apparent by reference to the following description of a preferred embodiment, from the drawings and from the claims.

Figure 1:
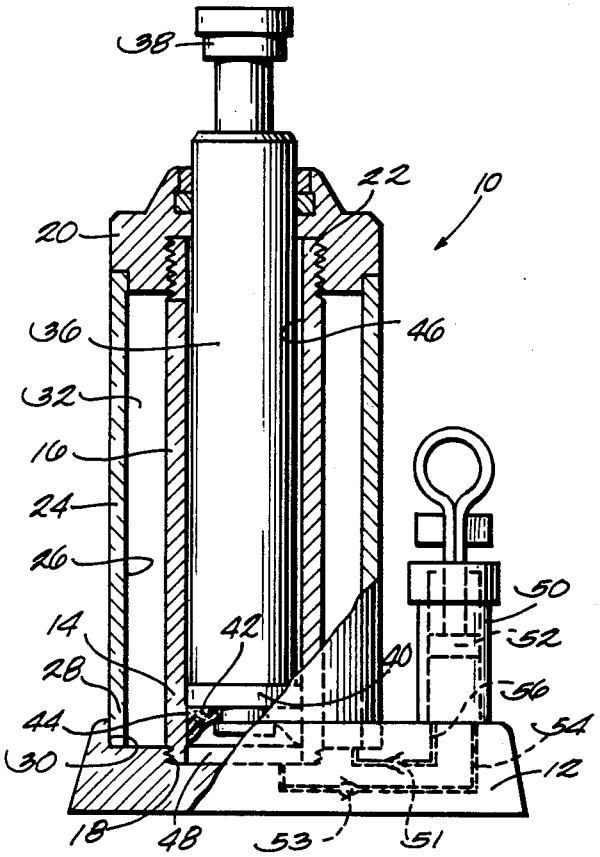
FIG. 1 is an elevation view partially in cross section of a hydraulic lift embodying the invention.
Figure 3:
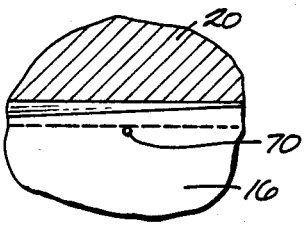
FIG. 3 is a cross section view taken along line 3—3 in FIG. 2.

Before describing a preferred embodiment of the invention in detail, it is to be understood that the invention is not limited to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a hydraulically operated jack 10 embodying the invention. The jack 10 includes a base 12 supporting the lower end 14 of a generally vertically extending ram cylinder 16. More specifically, the base 12 includes a threaded bore 18 housing the lower threaded end 14 of the cylinder 16. A cap 20 is threaded onto the upper threaded end 22 of the cylinder 16.

The vertically extending cylinder 16 is surrounded by a cylindrical tube 24 having an inner surface 26 spaced outwardly from the outside of the cylinder 16. The lower end 28 of the cylindrical tube 24 is housed in a complementary bore or recess 30 provided in the base 12, and the cylindrical tube 24 is forced downwardly into engagement with the base 12 by the cap 20. The space between the cylinder 16 and the tube 24 defines a reservoir 32 for hydraulic fluid.

A piston or ram 36 is reciprocably housed in the vertically extending ram cylinder 16 and includes an extensible upwardly extending end 38 adapted to support a load. The lower end 40 of the ram 36 carries a cup 42 having a peripheral surface 44 engaging the cylinder wall 46 in sealing engagement and functions to prevent flow of hydraulic fluid from the cylinder past the ram. As is conventional, the cup 42 is comprised of a resilient thermoplastic material.

Means are also provided for selectively pumping hydraulic fluid from the reservoir 32 into the lower end 48 of the cylinder 16. That means includes a pump cylinder 50 supported by the base 12 and housing a reciprocably movable pump piston 52. Hydraulic fluid passages 56 and 54 are provided in the base 12 to permit fluid flow between the reservoir 32 and the pump cylinder 50, and to permit flow between the pump cylinder 50 and the lower portion 48 of the ram cylinder 16. Conventional check valves 51 and 53 are also housed in the base 12 to control fluid flow from the reservoir 32 to the ram cylinder 48 in response to reciprocal pumping movement of the pump piston 52 in the pump cylinder 50.

Figure 2:
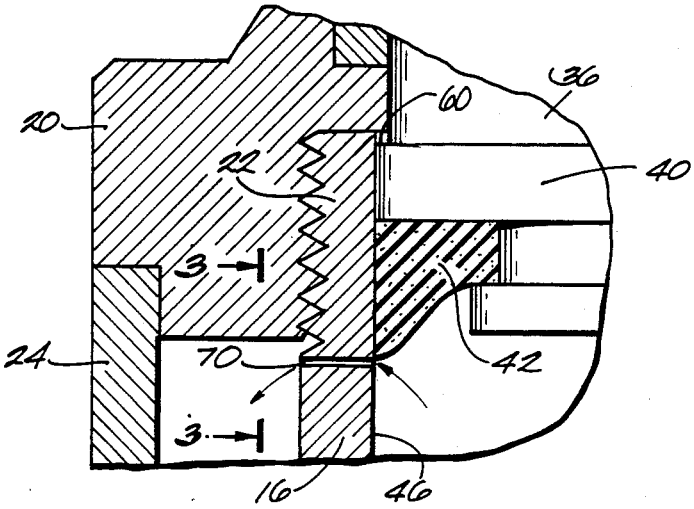
FIG. 2 is an enlarged view of a portion of the cylinder wall of the apparatus shown in FIG. 1.

Means are also provided for limiting the upward stroke of the ram piston 36 to thereby prevent the shoulder 60 of the piston head 40 from being forced against the cap 20. This means for limiting upward movement of the ram 36 includes means for selectively bleeding off hydraulic fluid from the hydraulic chamber 48 of the ram cylinder to the reservoir 32 when the end 40 of the ram piston 36 approaches the upper end of its stroke. As best illustrated in FIG. 2, a small diameter bore 70 extends radially through the wall of cylinder 16 adjacent the upper end of the cylinder to thereby provide a narrow diameter flow passage for hydraulic fluid from the hydraulic chamber 48 of the ram cylinder to the reservoir 32 once the end 40 of the piston and seal 42 move upwardly in the cylinder to a position wherein the bore 70 is uncovered.

In a preferred form of the invention the bleed port or passage 70 through the cylinder wall should be as small as possible in order to reduce scoring or wear of the exterior of the cup 42 as the cup 42 passes the hole 70. The hydraulic fluid pressure on the cup 42 forces the outer surface of the cup outwardly against the inner surface 46 of the cylinder 16 and tends to extrude the material of the cup 42 into the hydraulic pressure relief bore 70. If the pressure relief bore 70 has a large diameter, a greater portion of the periphery of the cup 42 is forced into the relief bore, and the scoring of the cup is increased. By providing a very small diameter relief bore, the material of the cup will slide over the bore opening and will not be extruded into the opening thereby avoiding scoring and wear of the cup. In a preferred form of the invention the hydraulic fluid relief bore 70 will have a diameter of approximately 0.010 to 0.012 inches.

Figure 4:
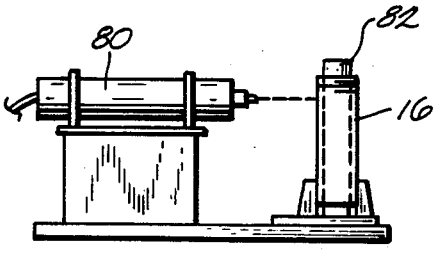
FIG. 4 is an elevation view of a laser forming a bleed port in a ram cylinder of the type illustrated in FIG. 1.

The small diameter bore 70 is formed in the cylinder wall 16 by use of a laser beam to burn a hole radially through the cylinder wall. In a preferred form of the invention a Model 400 pulse YAG laser, manufactured by Control Laser Corporation, Orlando, Fla. can be employed to form the small diameter bore through the cylinder wall. As illustrated for purpose of example in FIG. 4, the laser 80 and the cylinder 16 are supported such that the laser beam is directed radially through the wall of the cylinder 16 to form a bore 70 of substantially constant diameter through the cylinder wall. In one form of the invention a copper rod 82, having a diameter slightly smaller than the inside diameter of the ram cylinder 16 is inserted into the ram cylinder during operation of the laser 80 to prevent splattering of molten metal or residue material onto the interior surface of the ram cylinder when the laser beam burns through the cylinder wall to the interior surface. Means (not shown) for directing jets can also be provided of compressed air or oxygen at the area of the cylinder wall where the laser beam impinges against the cylinder wall to disperse any residue of the laser machining process.

In one form of the invention, the bore can be formed such that it will have a somewhat larger diameter at its outer end than at the end adjacent the interior surface. A bore having such a configuration will be less likely to be plugged or restricted by foreign matter.

Various features of the invention are set forth in the following claims.

I claim:

1. A hydraulic jack comprising a cylinder having opposite ends and a cylinder wall, the cylinder wall having an interior surface and an outer surface, and the cylinder having a central longitudinal axis, a ram having a head portion reciprocable in the cylinder between the cylinder ends, and a rod portion partially extending through one of the opposite ends of the cylinder, sealing means carried on the ram head portion to provide a substantially fluid tight seal between the ram head portion and the cylinder interior surface, and bleed port means for permitting the flow of fluid from the cylinder when the head portion moves to a position adjacent the one of the opposite ends of the cylinder so as to prevent forcing the ram head portion and the sealing means against the one of the opposite ends of the cylinder, the bleed port means including a bore extending through the cylinder wall between the interior surface and the outer surface, and the bore having a length extending generally radially through said cylinder wall, said bore having a diameter of less than approximately 0.015 inches along substantially its entire length whereby the material forming the sealing means will not flow into said bore when said sealing means is positioned such that a portion of said sealing means is adjacent said bore.

2. A hydraulic jack as set forth in claim 1 wherein said bore has a diameter of approximately 0.010 to 0.012 inches adjacent said cylinder interior surface.

3. A hydraulic jack as set forth in claim 1 wherein said bore has a substantially equal diameter along its length.

* * * * *